US006502265B2

(12) United States Patent
Blair et al.

(10) Patent No.: US 6,502,265 B2
(45) Date of Patent: Jan. 7, 2003

(54) INTERACTIVE CONTROL SYSTEM FOR A LAUNDRY APPLIANCE

(75) Inventors: Jeffrey L. Blair, Newton, IA (US); John F. Broker, Colfax, IA (US); Mitchell N. Corbett, Urbandale, IA (US); Douglas W. Gardner, Newton, IA (US); Brian L. Ness, Newton, IA (US); Douglas A. Ocshner, Newton, IA (US); Joel D. Rozendaal, Grinnell, IA (US); Kim L. Wright, Newton, IA (US)

(73) Assignee: Maytag Corporation, Newton, IA (US)

( * ) Notice: Subject to any disclaimer, the term of this patent is extended or adjusted under 35 U.S.C. 154(b) by 88 days.

(21) Appl. No.: 09/741,067

(22) Filed: Dec. 21, 2000

(65) Prior Publication Data

US 2002/0078511 A1 Jun. 27, 2002

(51) Int. Cl.[7] ..... D06F 33/02

(52) U.S. Cl. ..... 8/159; 68/12.27; 340/825.02; 340/825.22

(58) Field of Search ..... 8/159; 68/12.27; 340/825.02, 825.22, 309.4, 309.5

(56) References Cited

U.S. PATENT DOCUMENTS 4,084,237 A 4/1978 Beachem et al.
4,763,493 A 8/1988 Nishite et al.
4,977,394 A * 12/1990 Manson et al. ..... 68/12.27 X
5,124,908 A 6/1992 Broadbent
5,279,134 A * 1/1994 Nonogaki et al. ..... 68/12.27
5,585,704 A 12/1996 Elzind
5,694,793 A * 12/1997 Nishimura et al. ..... 68/12.27

FOREIGN PATENT DOCUMENTS

JP 5345090 12/1993

OTHER PUBLICATIONS

US 2001/0042391 AI, 11–2001, Wobkemeier, 68/12.27.*

* cited by examiner

*Primary Examiner*—Philip Coe
(74) *Attorney, Agent, or Firm*—Diederiks & Whitelaw, PLC

(57) ABSTRACT

A system for operating and programming a laundry appliance includes a menu system giving a user extreme flexibility in operating the appliance. Through a series of menu screens, the user is presented with a variety of available options. Additionally, the laundry appliance of the invention gives the user access to databases, preferably already programmed into memory of the appliance, such as general tips for laundering and simple troubleshooting. Finally, the user has the ability to program the menu system.

15 Claims, 10 Drawing Sheets

B
150
HELP
HOW TO...
BEFORE CALLING FOR SERVICE...
SERVICE MENU
RETURN TO MAIN MENU
160
HOW TO...
SORT LAUNDRY
SELECT CORRECT CYCLE
SELECT AND MEASURE...
DETERGENT
BLEACH
SOFTENER
RETURN TO HELP MENU
170
BEFORE CALLING FOR SERVICE...
CHECK WATER SUPPLY
CHECK DRAIN HOSE
CALL CAIR CENTER
AT 1-800-###-####
RETURN TO HELP MENU
240
SET UP MODE
CYCLE SET UP
COUNTER SET UP
LANGUAGE SET UP
RETURN TO SERVICE MENU
E
F

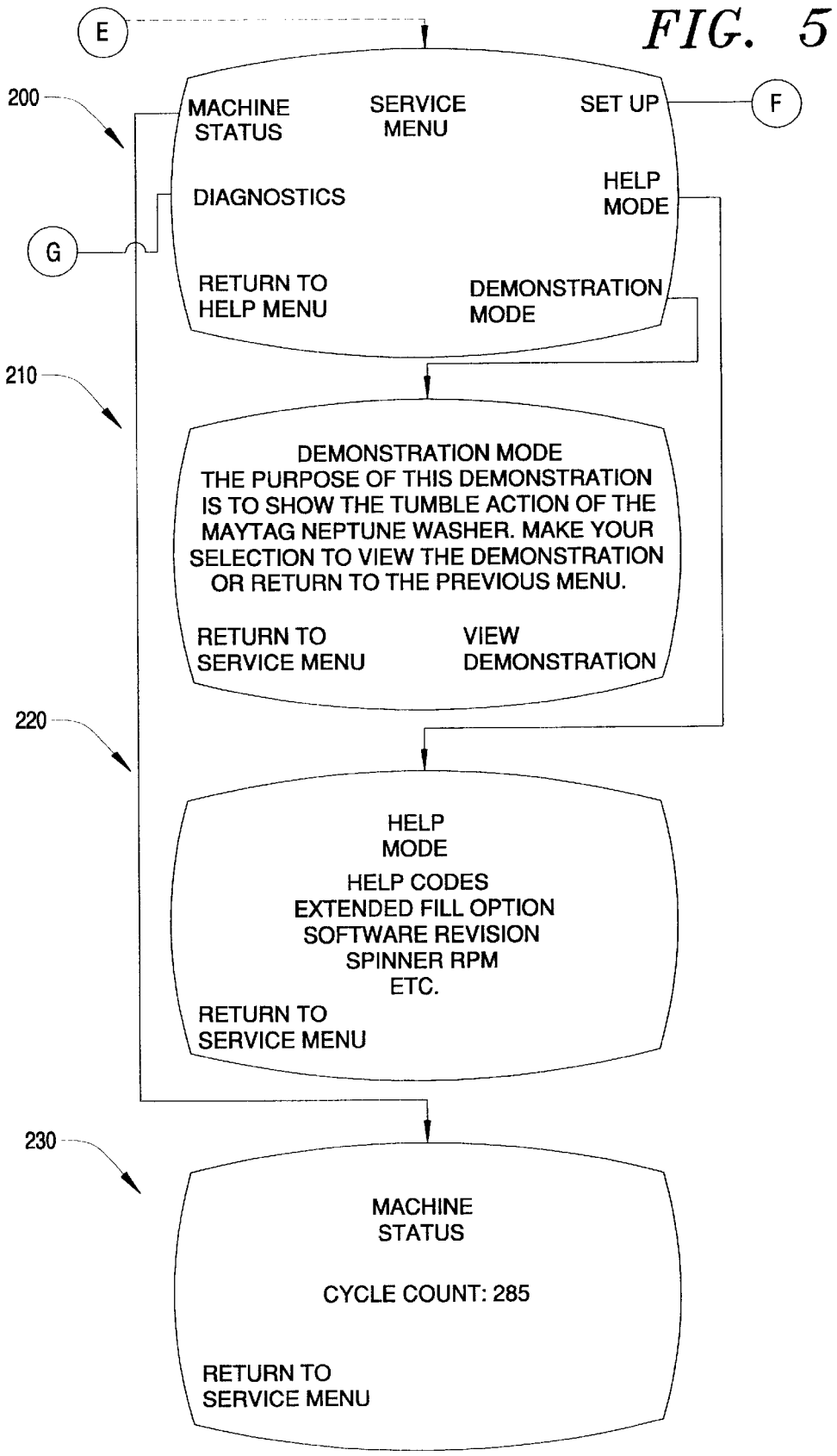
FIG. 5
E
200
MACHINE STATUS
SERVICE MENU
SET UP
F
DIAGNOSTICS
HELP MODE
G
RETURN TO HELP MENU
DEMONSTRATION MODE
210
DEMONSTRATION MODE
THE PURPOSE OF THIS DEMONSTRATION IS TO SHOW THE TUMBLE ACTION OF THE MAYTAG NEPTUNE WASHER. MAKE YOUR SELECTION TO VIEW THE DEMONSTRATION OR RETURN TO THE PREVIOUS MENU.
RETURN TO SERVICE MENU
VIEW DEMONSTRATION
220
HELP MODE
HELP CODES
EXTENDED FILL OPTION
SOFTWARE REVISION
SPINNER RPM
ETC.
RETURN TO SERVICE MENU
230
MACHINE STATUS
CYCLE COUNT: 285
RETURN TO SERVICE MENU

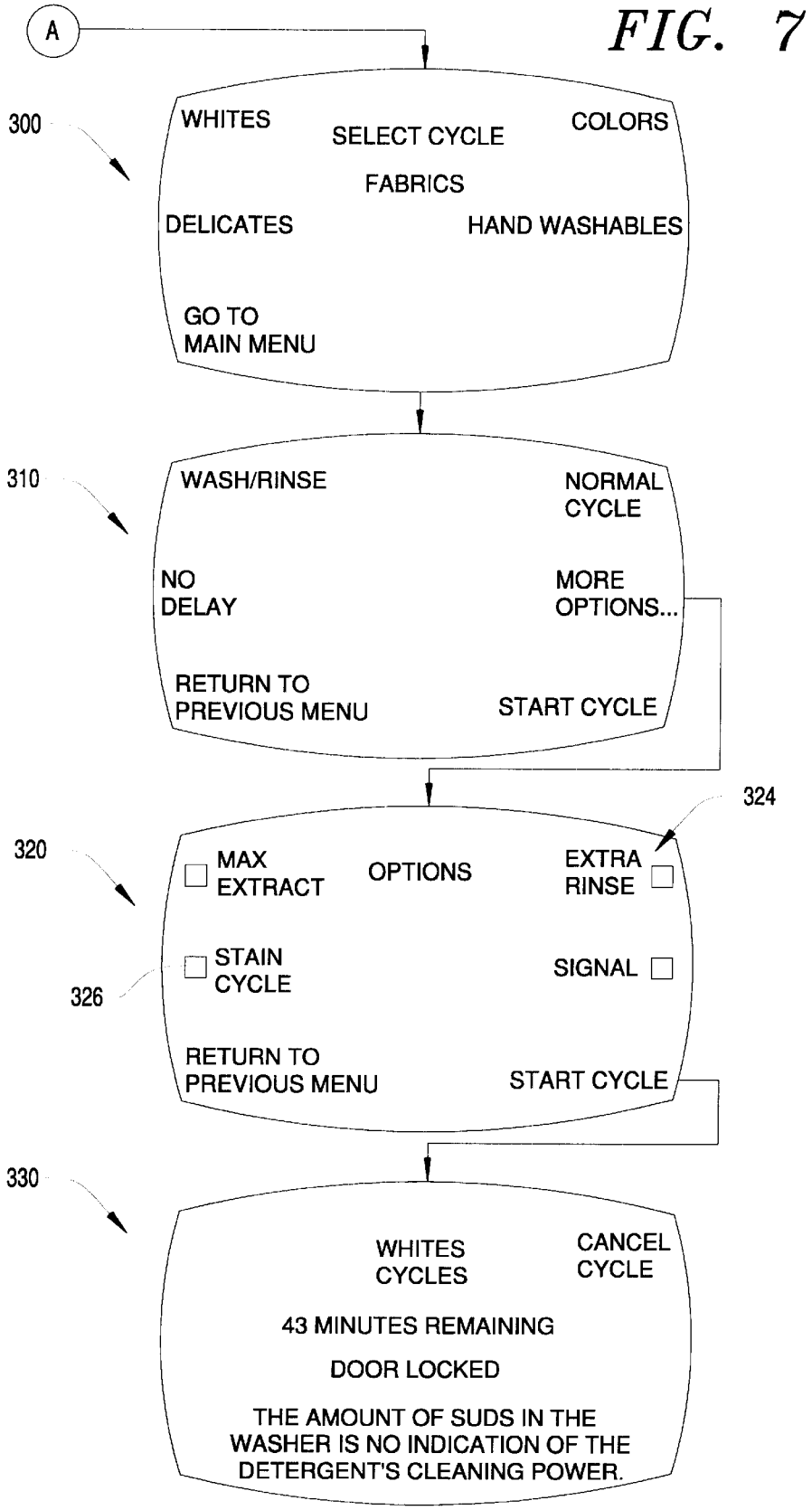
FIG. 7
A
300
WHITES
SELECT CYCLE
COLORS
FABRICS
DELICATES
HAND WASHABLES
GO TO
MAIN MENU
310
WASH/RINSE
NORMAL
CYCLE
NO
DELAY
MORE
OPTIONS...
RETURN TO
PREVIOUS MENU
START CYCLE
324
320
MAX
EXTRACT
OPTIONS
EXTRA
RINSE
STAIN
CYCLE
326
SIGNAL
RETURN TO
PREVIOUS MENU
START CYCLE
330
WHITES
CYCLES
CANCEL
CYCLE
43 MINUTES REMAINING
DOOR LOCKED
THE AMOUNT OF SUDS IN THE
WASHER IS NO INDICATION OF THE
DETERGENT'S CLEANING POWER.

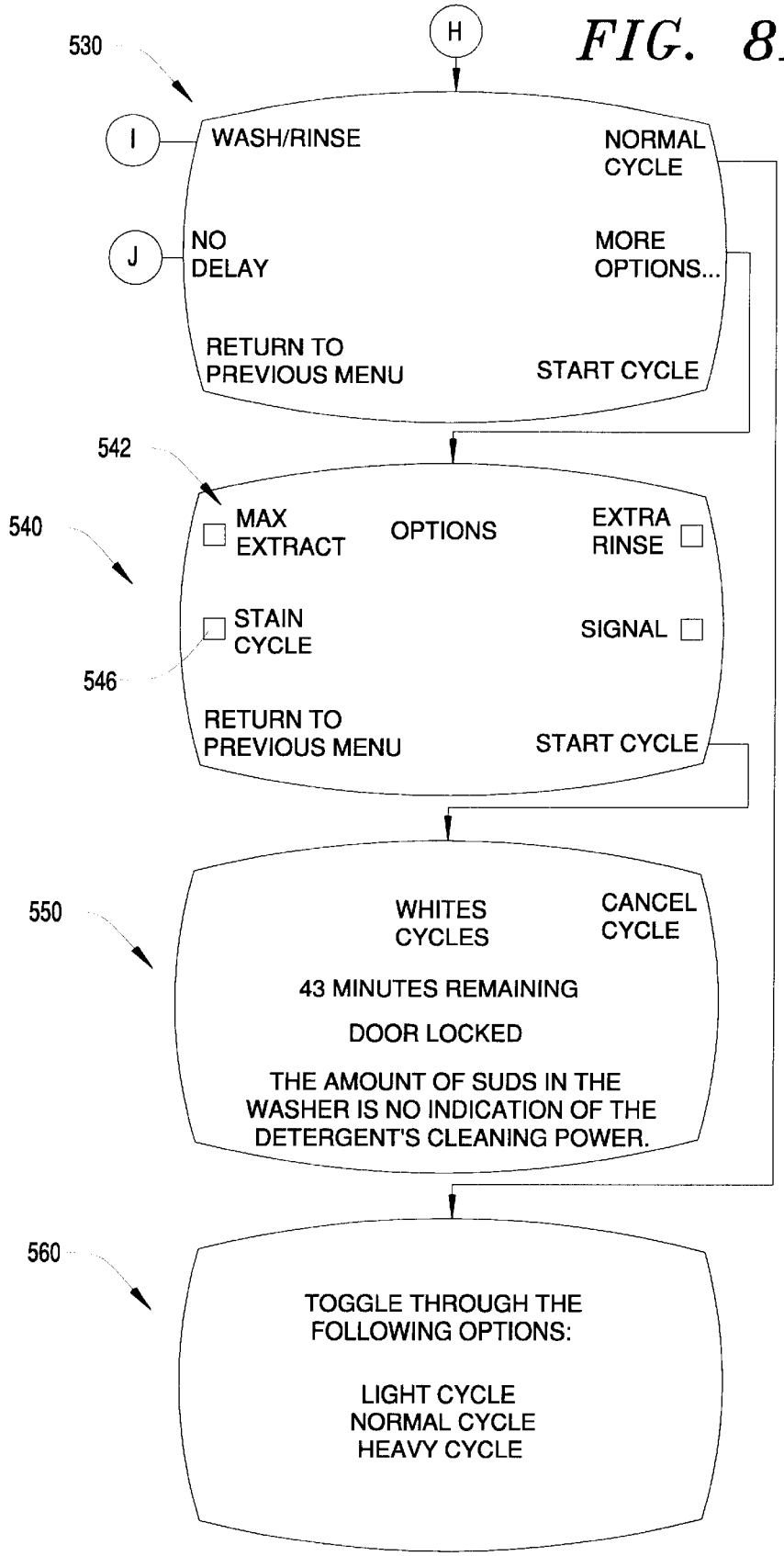
FIG. 8B
530
H
I
WASH/RINSE
NORMAL CYCLE
J
NO DELAY
MORE OPTIONS...
RETURN TO PREVIOUS MENU
START CYCLE
542
540
MAX EXTRACT
OPTIONS
EXTRA RINSE
STAIN CYCLE
SIGNAL
546
RETURN TO PREVIOUS MENU
START CYCLE
550
WHITES CYCLES
CANCEL CYCLE
43 MINUTES REMAINING
DOOR LOCKED
THE AMOUNT OF SUDS IN THE WASHER IS NO INDICATION OF THE DETERGENT'S CLEANING POWER.
560
TOGGLE THROUGH THE FOLLOWING OPTIONS:
LIGHT CYCLE
NORMAL CYCLE
HEAVY CYCLE

INTERACTIVE CONTROL SYSTEM FOR A LAUNDRY APPLIANCE

BACKGROUND OF THE INVENTION

1. Field of the Invention

The present invention pertains to the art of laundry appliances, and more particularly, to a menu driven electronic interface system used in controlling the operation of a laundry appliance.

2. Discussion of the Prior Art

Automatic commercial washing machines have traditionally been operated from stored programs or manually actuated buttons. There is known in the art of washing machines a large number of electronic control systems for washing machines which arrive from the factory with a variety of settings. These settings often include wash temperatures and time settings for the various operations performed by the washing machine. Commonly present in modern washing machines are settings which optimally clean different fabrics. Depending upon the type of fabric chosen, the settings direct the various operations of the washing machine. It is also known in the art to provide on-premise laundry systems with pre-programmed operational cycles. Frequently, these pre-programmed operational cycles are organized into a slate which gives a user a number of different cycles from which to choose.

Because the cycles are pre-programmed at the factory, each machine is particularly designed for a specific environment. Typically, a machine is pre-programmed with cycles relating to types of fabric usually found in that environment. For example, a machine may be programmed with a slate directed to the fabrics found in a home, hotel, hospital, restaurant, or health club. Because the types of soiled fabrics differ in each environment, the slate is specifically tailored to the types of fabric used, as well as typical stains found on the fabrics, in that environment. For example, if a machine is to be used in a hospital, the cycles from which the user may choose are pre-programmed to optimally clean the fabrics typically found in a hospital setting. If the machine was to be used in a health club, the cycles would differ because the typical fabrics and stains encountered in a health club vary from that of a hospital. Therefore, depending upon the expected location and environment of the machine, the various cycles available are preset at the factory or by the installer.

In a domestic washing machine, the cycles are often designed to clean the fabrics and stains usually encountered in the home. Most commonly, one cycle is provided for whites, another for colors, and a third for delicates. In any event, the manufacturer provides the machine with the various cycles pre-programmed. In general, the various cycles can be accessed by a consumer of the washing machine through a series of buttons and/or a rotating dial. When a specific cycle is desired, a user only needs to press an appropriate button, perhaps in combination with setting the dial, on the face of the washing machine to begin the operation. This design, while simple to manufacture and operate, limits the versatility of the overall system to most effectively clean a wide range of fabrics.

U.S. Pat. No. 5,585,704 to Elzind teaches incorporating a microprocessor based control system into a washing machine in order to allow the changing of pre-programmed cycles after installation. The system proposes to replace the pre-existing manual operation push buttons with a module connected to an automatic controller. The controller includes a control circuit which uses a series of manual push buttons. Through the manual push buttons, the user is able to select between various wash programs. The controller also includes a removable and replaceable solid-state memory card which stores multiple wash programs. These memory cards, once inserted into a memory card driver present on the machine, provide multiple wash programs to the machine, allowing the archiving and up-loading of various wash programs. Although the system allows the alteration of various wash cycles programmed in a washing machine, the selection of wash cycles is limited to those present on the memory cards. Additionally, such a system requires external peripherals to add more settings. Therefore, users are limited to the current slate programmed into the machine. In addition, although it may be possible to load other cycles into the machine, it is difficult to change each of the cycles for optimal use in another environment. Additionally, a new slate of cycles cannot easily be loaded into the machine. Furthermore, with conventional washing machines, changing the individual parameters, other than a single wash cycle, is difficult at best.

Therefore, there exists a need in the art for a domestic washing machine which is manufactured with a variety of washing operations and is capable of taking on supplementary cycle operations at the direction of the user. There also exists a need for a more user friendly system for controlling the operation of a washing appliance, rather than a conventional mechanical button operation. More specifically, there exists a need for an electronic control system which functions to prompt a user, as needed, to input certain washing information in a convenient and concise manner, and then automatically controls the washing appliance to perform the desired operation. Furthermore, there is a need for an electronic washing appliance control system which can itself be programmed to perform various operations in a desired manner, such as following a personal washing schedule stored in the system by the user. Corresponding needs exist in other known laundry appliances as well.

SUMMARY OF THE INVENTION

The present invention pertains to a system for programming and operating a laundry appliance, based on selections made by a user. In the most preferred embodiment wherein the invention is employed in a washing appliance, a menu driven display, such as a touch screen, is used to prompt a user for programming inputs, as simple as the type of fabric to be cleaned to the degree or level of soiling, or as complex as the desired water extraction speed and temperature. In addition to prompting the user for necessary programming information, the washing appliance can pause the programming sequence to automatically perform rinse, extract, or dispensing sequences as needed, preferably while displaying a control screen to the user concerning the function being performed.

Additionally, the user is provided with a plurality of menu screens with which to operate and control the washing machine of the invention. Specifically, the washing machine includes a touch screen which allows the user to start the operation of the machine simply by pressing the correct area of the touch screen. The touch screen also gives the user access to a variety of databases, including washing instructions and tips, as well as help information for operating and programming the washing machine.

Additional objects, features and advantages of the present invention will become more readily apparent from the following detailed description of preferred embodiments thereof when taken in conjunction with the drawings wherein like reference numerals refer to corresponding parts in the several views.

BRIEF DESCRIPTION OF THE DRAWINGS

FIG. 5 is a diagrammatic representation of operating screens seen by the user during a service sequence;

FIG. 7 is a diagrammatic representation of operating screens seen by the user during a cycle programming sequence;

FIG. 8B is a diagrammatic representation of operating screens seen by the user during a general sequence.

DETAILED DESCRIPTION OF THE PREFERRED EMBODIMENTS

Figure 1:
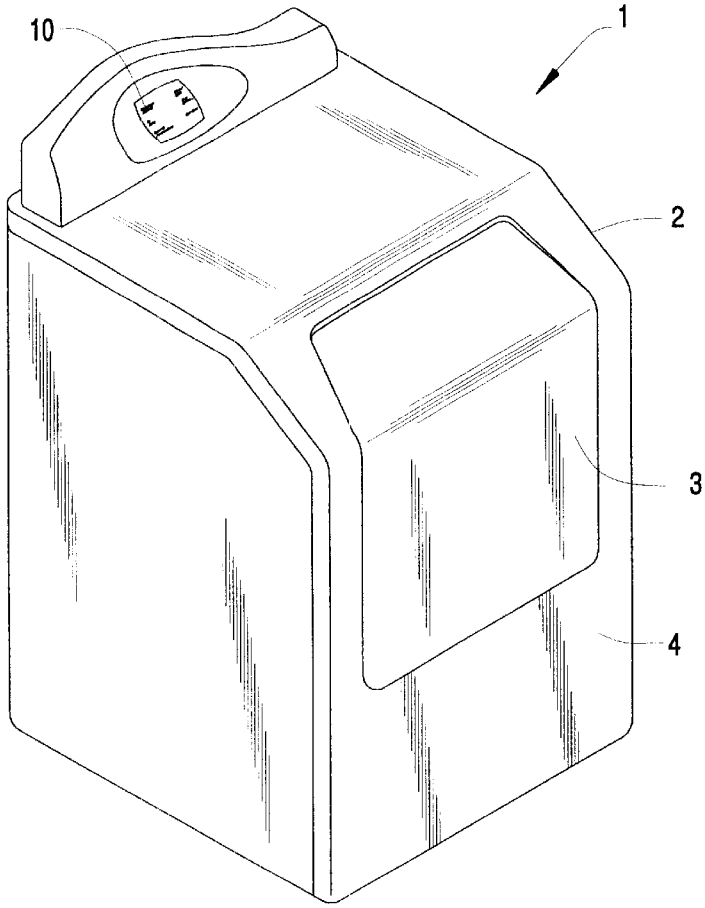
FIG. 1 is a perspective view of a domestic washing machine incorporating the menu driven control system of the invention.
Figure 2:
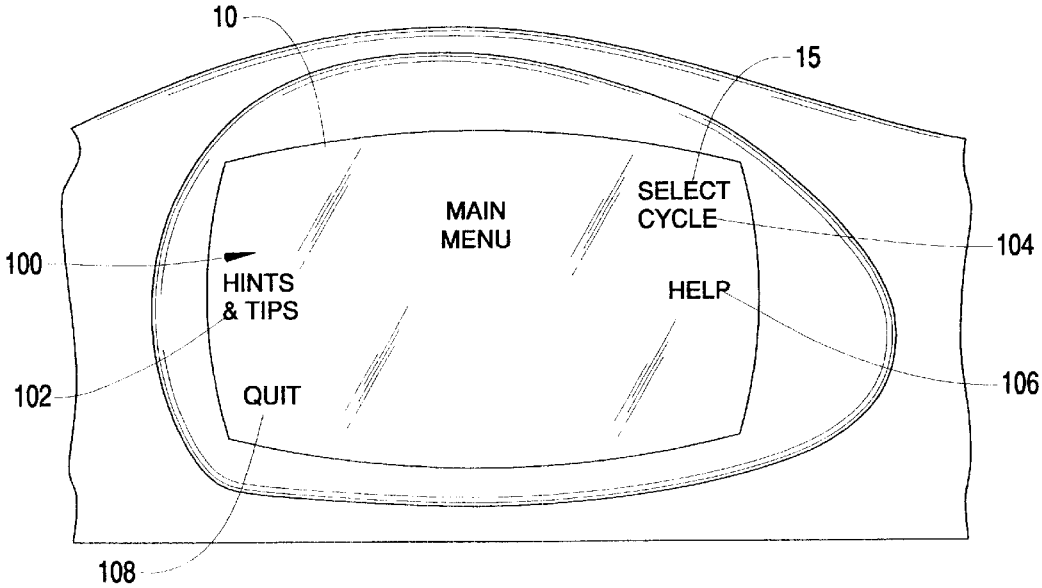
FIG. 2 is a detailed view of the display, including an initial operating screen as presented to a user.

With initial reference to FIG. 1, an appliance 1 is schematically shown in the form of a washing machine. Appliance 1 includes a cabinet 2 provided with a door 3 in a front face 4. Door 3 is designed to be pivoted to expose an integral washing tub (not shown). A display 10 is provided through which a user controls and programs washing appliance 1. As will become more fully evident below, the particular construction of washing appliance 1 can significantly vary in accordance with the present invention. Display 10 includes a plurality of selectable control areas or zones 15 (see FIG. 2), which can be accessed by a user to both program and operate washing machine 1.

In the most preferred form of the invention, display 10 takes the form of an LCD display, such as a 128×96 dot matrix, touch screen display, which enables a user to readily review displayed data, preferably in alpha or word text format, and select from that data to establish and begin a desired washing operation. Display 10, although shown with the various selectable areas 15 near or close to the comer and side portions of display 10, could have the selectable areas 15 at any location on the display. The manner in which washing appliance 1 operates in accordance with the most preferred embodiment will be described in detail below, particularly with reference to the diagrams of FIGS. 3–7. However, at this point it, should be realized that, in addition to the control options presented in these figures, appliance 1 may also include various buttons, such as "POWER", used to selectively turn on or off washing appliance 1, and "BACK/CLEAR", used to erase an inadvertently inputted control parameter through display 10. Additionally, display 10 may include a FAVORITES button which gives the user quick access to the most often used cycles and functions.

Reference will now be made to FIG. 3 in describing various, preferred programming sequences in accordance with the invention. Upon activating washing machine 1, a user is presented with screen 100. As shown, screen 100 preferably presents various operating options for washing appliance 1. With screen 100 displayed, the user can select a desired operating command, referably by simply touching a portion of display 10 in which a key word is indicated. As shown, the user can select "Hints & Tips", "Select Cycle", "Help", or "Quit" options. Further details of the operation of washing appliance 1 upon selecting each of the options will be presented more fully below.

Figure 3A:
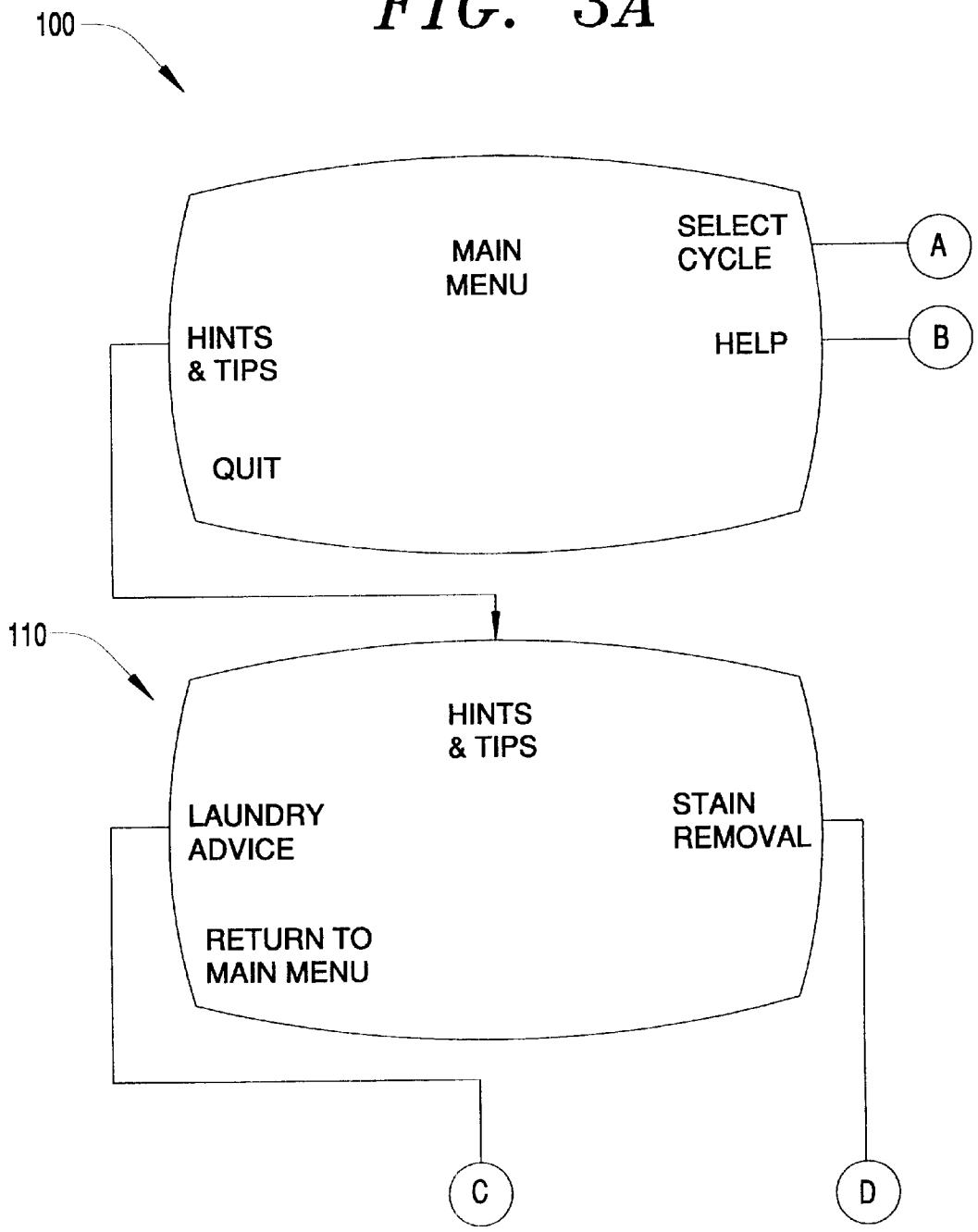
FIG. 3A is a diagrammatic representation of the first operating screen.

FIG. 3A particularly illustrates a preferred sequence when the user programs washing appliance 1 under the "Hints & Tips" option. Specifically, the "Hints & Tips" option is used to access washing assistance databases preferably stored in memory of washing appliance 1, and changes display 10 to a different screen configuration, screen 110. Alternatively, the databases may be stored in external accessible memory. As shown in FIG. 3*a,* the user can select from "Laundry Advice" or "Stain Removal", as well as "Return to Main Menu".

Figure 3B:
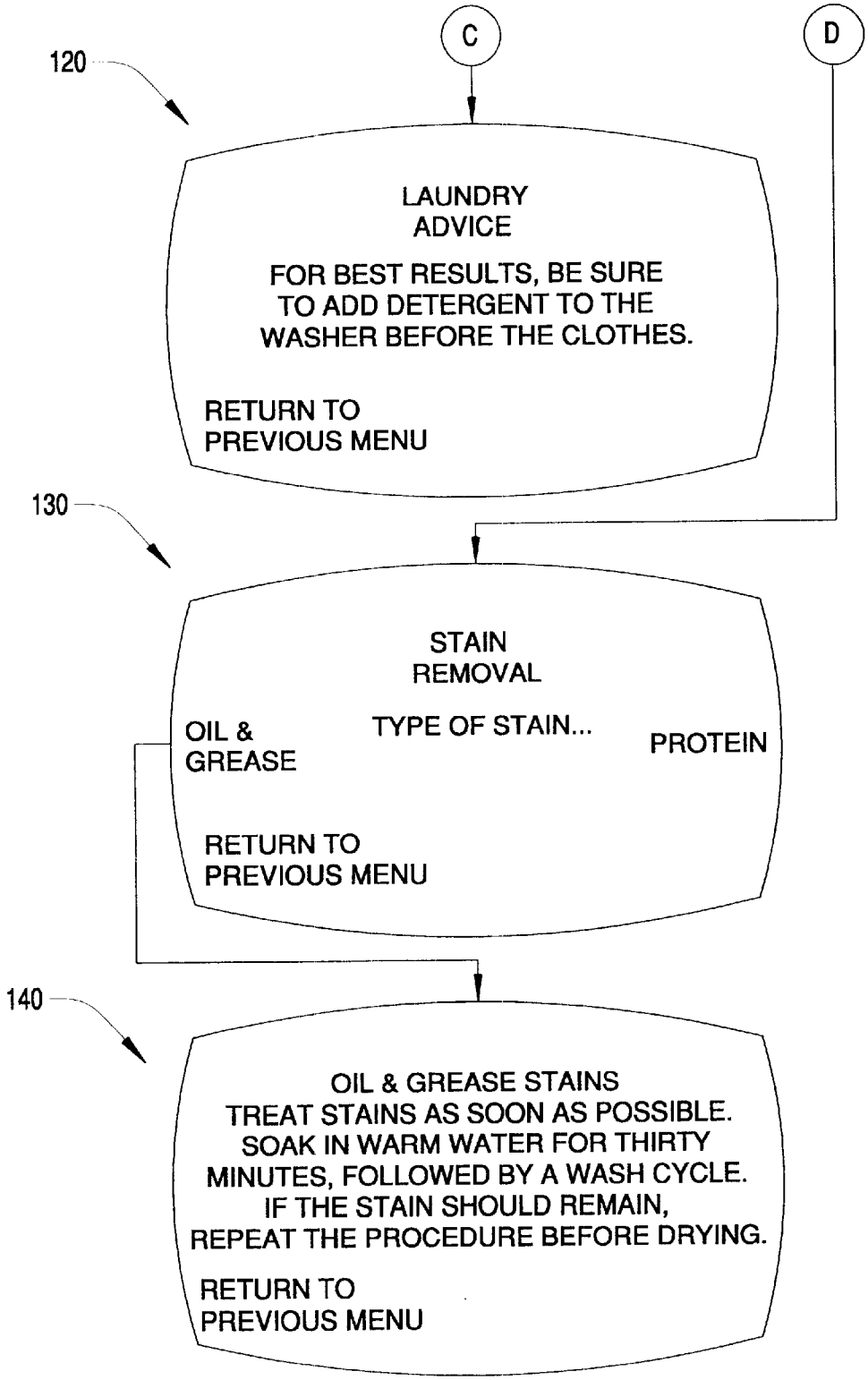
FIG. 3B is a diagrammatic representation of operating screens seen by the user during general operation.

Selecting the "Laundry Advice" option from screen 110 accesses screen 120, as shown in FIG. 3B. The "Laundry Advice" option causes washing appliance 1 to access a stored database containing a variety of suggestions for washing, and to display one of the suggestions contained therein. Because washing appliance 1 preferably, randomly displays a suggestion from the database, repeatedly selecting the "Laundry Advice" option will successively display additional suggestions.

Also shown in FIG. 3B is screen 130 which is entered by selecting the "Stain Removal" option from screen 110. Screen 130 presents the user with common types of stains, or an alphabet listing used to input spelling information on a common stain, and, by selecting the specific stain type, suggestions for best cleaning of that type of stain. As shown, screen 130 includes exemplary options for "Oil & Grease" and "Protein". Screen 140 results from selecting the "Oil & Grease" option. Although screen 130 is shown as including only two specific stain types, screen 130 may include a variety of additional stain types, such as "Grass". Additionally, screen 130 may present the user with an algorithm with which to determine the type of stain. Furthermore, although screen 140 is shown as presenting particular advice on cleaning an oil and grease stain, it must be remembered that screen 140 is only exemplary and that washing appliance 1 can change screen 140, depending upon the desired instructions and type of stain chosen in screen 130.

Figure 4:
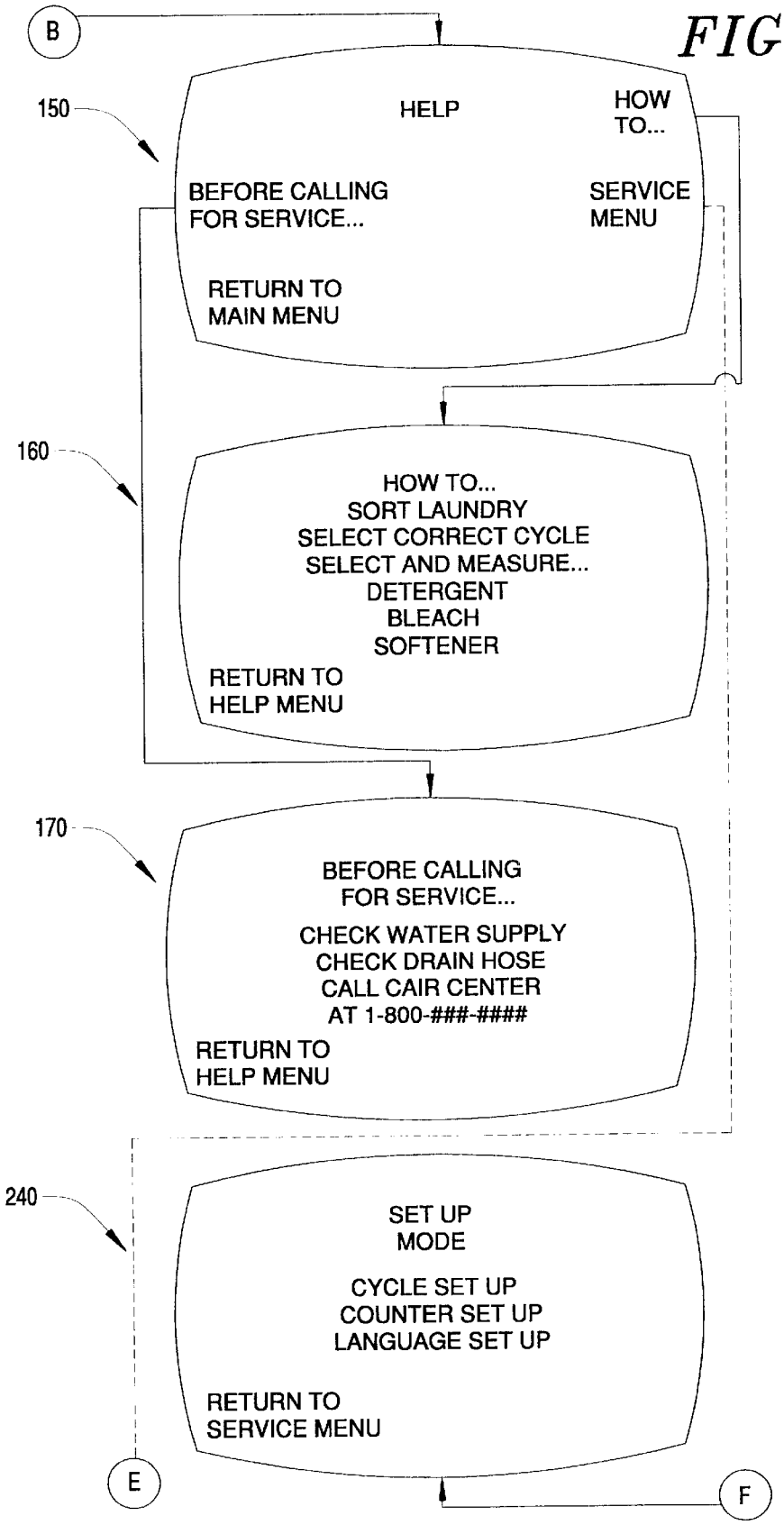
FIG. 4 is a diagrammatic representation of operating screens encountered by the user during a help sequence.

Washing appliance 1 is provided with a help sequence, shown in detail in FIG. 4, which is activated by selecting the "Help" option from screen 100. The help sequence is initially displayed to the user in screen 150. Selecting a "How to . . . " option from screen 150 causes washing appliance 1 to display screen 160, which presents the user with a variety of general washing procedures and suggestions for each. It is also within the scope of this invention to provide a plurality of additional screens which can be accessed by selecting one of the washing procedures for additional help and suggestions.

Screen 150 also provides the user with a "Before Calling for Service . . . " option which presents a series of commands to the user to perform before calling a service technician, and causes display 10 to show screen 170. These commands are designed to alleviate the necessity of calling the service technician prior to considering basic potential problem areas, such as checking the various supply and waste hoses. The specific text displayed in screen 170 is only to be considered exemplary, and may alternatively show other suggestions, as well as provide additional screens which assist the user with an algorithm to determine the problem.

A "Service Menu" option is also provided from screen 150 as shown in detail in FIG. 5. Selecting this option changes display 10 to screen 200 and gives the user a variety of additional options for servicing washing appliance 1. A "Demonstration Mode" option is available, through which the tumble action, or other washing operations, are exhibited (screen 210). Additionally, a "Help Mode" option is provided, wherein "Help Codes", "Extended Fill Option", "Software Revision", "Spinner RPM", as well as other types of service help information are displayed (screen 220).

Selecting a "Machine Status" option shows the current condition of washing appliance 1. Screen 230 shows the number of cycle counts as one potential condition which may be displayed.

Selecting a "Set Up" option from the service menu screen 200 gives the user the ability to set up the washing operation of washing appliance 1. Specifically, screen 240 (see FIG. 4) presents the user with a "Cycle Set Up" option, a "Counter Set Up" option, and a "Language Set Up" option" as a sample of the type of options given in the setup mode. The "Cycle Set Up" option is used to redefine one or more steps of an individual cycle, such as demonstrated in co-assigned U.S. patent application entitled, "Progranmable Laundry Appliance", filed on even date herewith, and incorporated herein by reference. The "Counter Set Up" option is used to display and reset a running counter which calculates the number of times each cycle has been actuated and, optionally, the number of times each of the menu systems has been accessed, as well as error code counts. The "Language Set Up" option can be used to change the language which is displayed by washing appliance 1. That is, because washing appliance 1 has access to an internal or an external database, it is possible to have a non-English language displayed.

Figure 6:
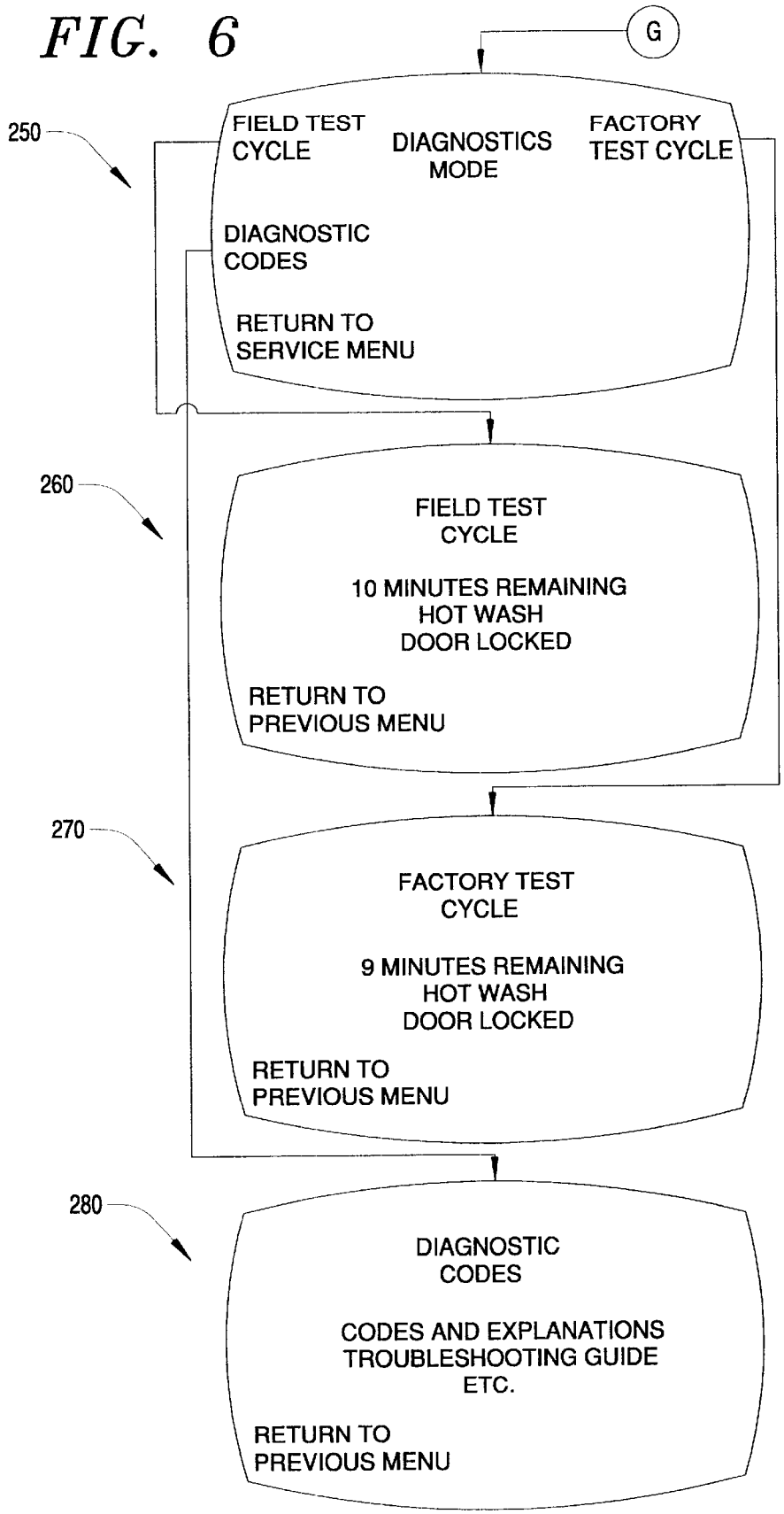
FIG. 6 is a diagrammatic representation of operating screens seen by the user during a diagnostic sequence.

FIG. 6 diagrams the screens of a diagnostics mode of the washing appliance 1, which is accessed via a "Diagnostics" option from screen 200. An initial screen 250 of the diagnostics mode presents the user with a "Field Test Cycle" option which runs washing appliance 1 through a specially designed diagnostic cycle to test the operation of washing appliance 1. Screen 260 shows a preferred screen displayed during the "Field Test Cycle" option to convey the current status and progression of the test cycle. A similar "Factory Test Cycle" option is provided, which runs washing appliance 1 through a different specially designed diagnostic cycle to test the operation of washing appliance 1. Screen 270 shows a preferred screen displayed during the "Factory Test Cycle" option to indicate the current status and progression of the test cycle. Screen 280 shows codes, explanations and troubleshooting guides resulting from the selection of the "Diganostics Codes" option from screen 250.

Choosing a "Select Cycle" option from screen 100 presents the user with a set of cycles and operations from which to choose, as best shown in FIG. 7. First, the user chooses the type of fabric to be cleaned in screen 300. Next, via screen 310, the user chooses the type of cycles to be followed. Specifically, screen 310 shows a "Normal Cycle", a "Wash/Rinse", and a "No Delay" cycle, but optionally may contain various types of automatic cycle used in domestic or commercial washing machines. The parameters, such as wash temperature, spin speed, and additive used, are determined by the selection of fabric type and wash type. Sample types of cycles are demonstrated in the above-identified co-pending application entitled, "Programmable Laundry Appliance".

Selecting "More Options . . . " presents the user with screen 320. Screen 25 320 essentially includes a plurality of washing options 324 and associated check-boxes 326. For example, screen 320 is shown with options for "Max Extract", "Stain Cycle", "Extra Rinse" and "Signal", which each relate to different aspects of the washing cycle. When a specific washing option is selected, the user only needs to touch the desired washing option 324 or its check-box 326. Once selected, check-box 326 is filled on display 10, with a check symbol or by otherwise filling in check-box 326. Because only the contents of check-box 326 changes when washing option 324 is selected, the user is given the ability to choose one or more washing options 324 without substantial change in display 10, until "Start Cycle" is selected.

At this point, it should be realized that the options presented in screen 320 are only a sample of the potential options which may be presented to the user. The "Max Extract" option, when selected, causes washing appliance 1 to spin a washing tub (not shown) at an elevated RPM and for an extended time during the final extract step of the washing cycle. The "Stain Cycle" is a specially designed additional set of steps added to the cycle which increases the stain removal capabilities of washing appliance 1. Washing appliance 1 may additionally include a series of screens through which the user can define the type of stain to better assist washing appliance 1 in removing the stain. The "Signal" option, when selected, turns on an audible signal to alert the user of the completion of a selected cycle. It is also contemplated that the signal can be delivered via other means, i.e. telephone call, facsimile, or electronic mail, if washing appliance 1 is so equipped. However, it must be remembered that these options are only a representative sample of the types of options which are available through screen 320. It is also contemplated that screen 320 can be replaced with a plurality of screens, or even a scrolling screen, giving more space for presentation and selection of the available options. Screen 320, as well as screen 310, also preferably includes a "Start Cycle" option through which washing appliance 1 begins the washing cycle. Screen 330 is then shown to display information such as fabric type, time remaining and door lock status as the cycle progresses.

Figure 8A:
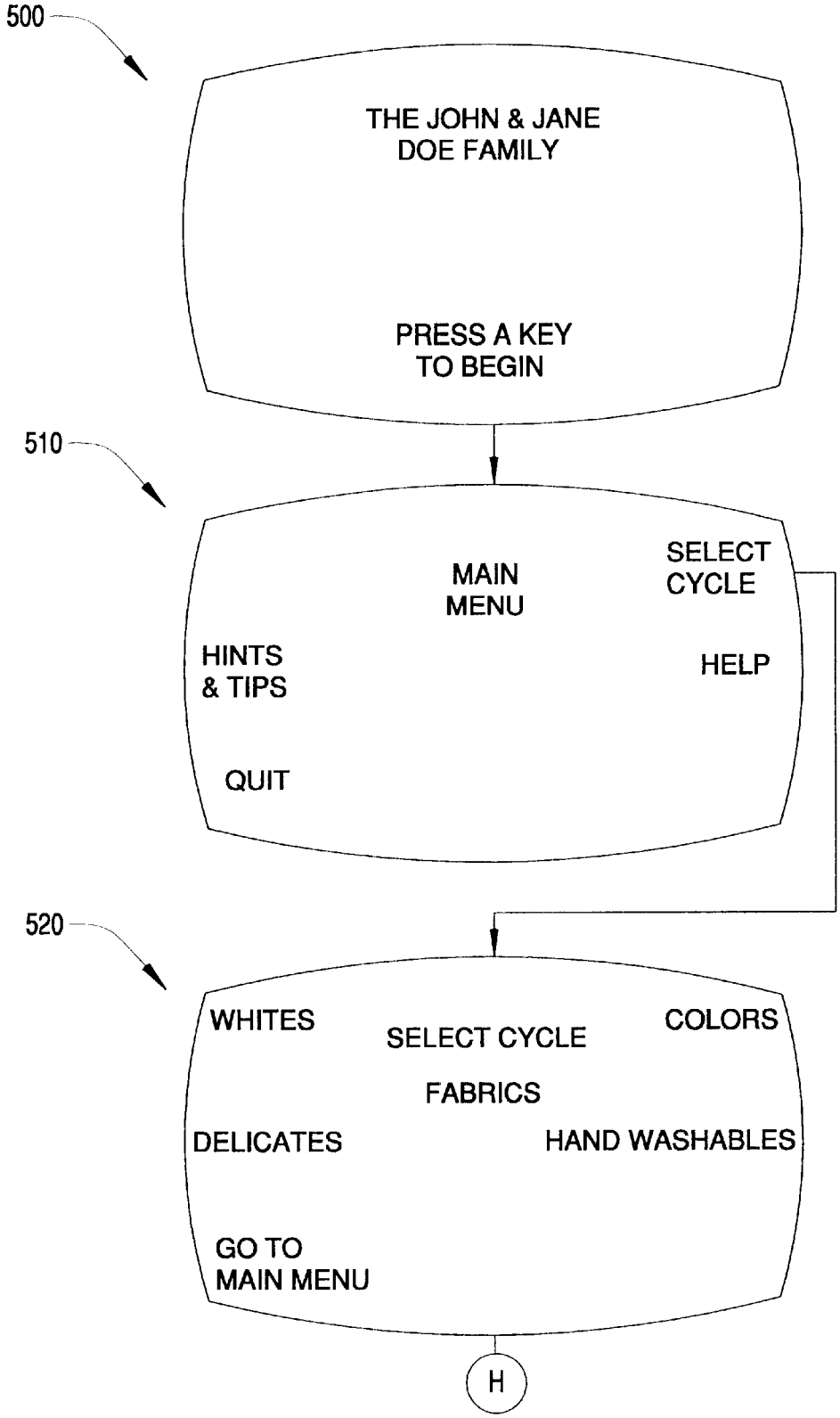
FIG. 8A is a diagrammatic representation of a second embodiment of an initial operating screen set as presented to the user.
Figure 8C:
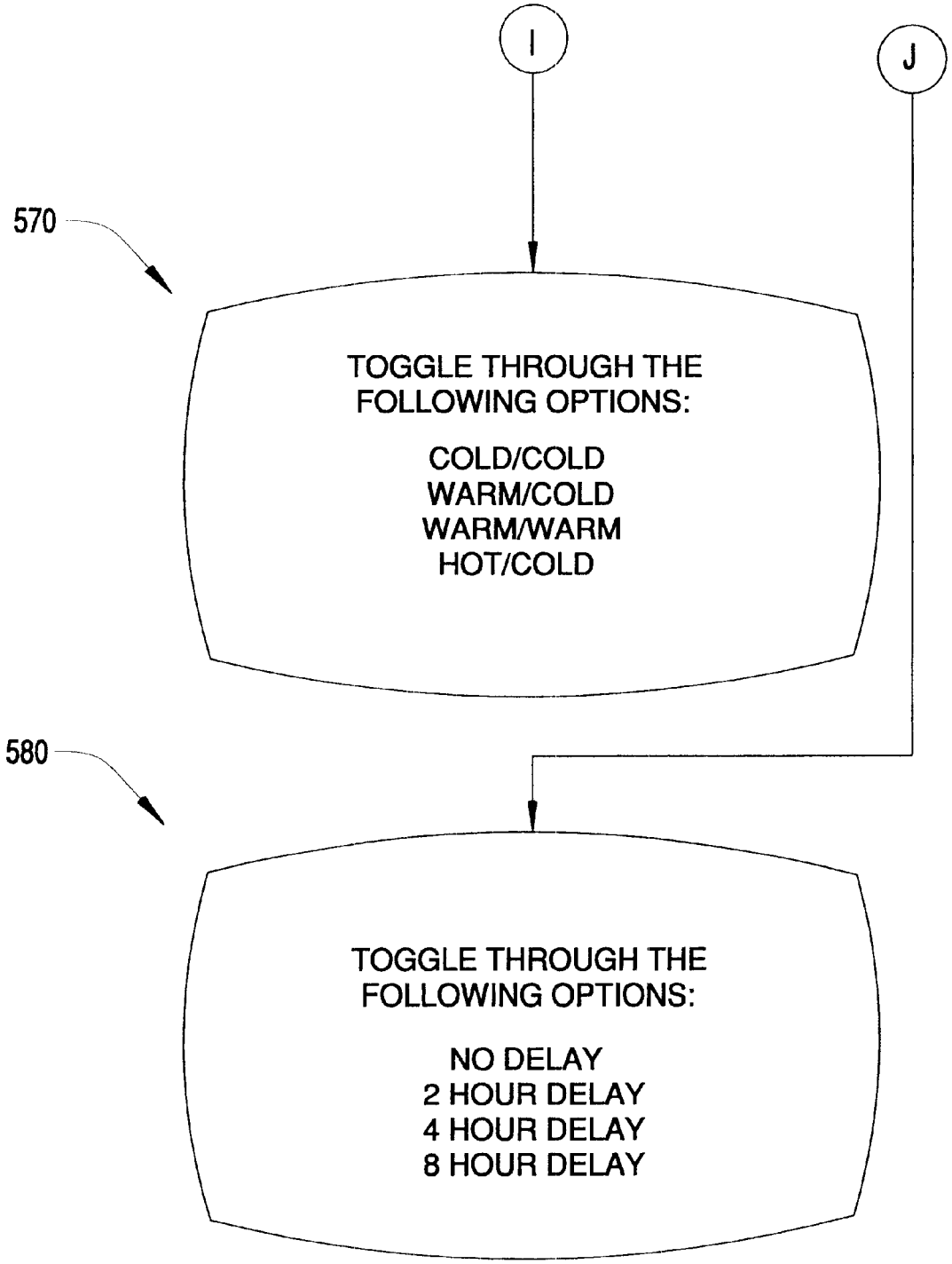
FIG. 8C is a diagrammatic representation of operating screens seen by the user during a cycle programming sequence.

FIGS. 8A, 8B and 8C demonstrate a menu control system in accordance with a second embodiment of the invention. Preferably, the menu control system of this embodiment is somewhat simpler than the system of the first embodiment. Initially, as shown in FIG. 8A, the user is presented with screen 500. Screen 500 has been designed with custom information, such as a family name, but may alternatively include any customized alphanumeric information. Touching any specified area of screen 500 moves to screen 510, which is similar to screen 100 of the first embodiment. As shown, screen 510 preferably presents various operating options for washing appliance 1. With screen 510 displayed, the user can select a desired operating command, preferably by simply touching a portion of display 10 in which a key word is indicated. As shown, the user can select "Hints & Tips", "Select Cycle", "Help", or "Quit" options.

The "Select Cycle" option changes display 10 to screen 520. First, the user chooses the type of fabric to be cleaned. Next, via screen 530, the user chooses the type of cycle to be used. Specifically, screen 530 shows a "Normal Cycle", a "Wash/Rinse", and a "No Delay" cycle, but optionally may contain any type of automatic cycle used in a domestic or commercial washing machine. The parameters, such as wash temperature, spin speed, and additive used, are determined by the selection of fabric type and wash type. Sample types of cycles are also demonstrated in the co-pending application entitled, "Programmable Laundry Appliance", as referenced above.

Selecting "More Options . . . " presents the user with screen 540. Screen 540 essentially includes a plurality of washing options 542 and associated check-boxes 546. For example, screen 540 is shown with options for "Max Extract", "Stain Cycle", "Extra Rinse" and "Signal", each of which relates to different aspects of the washing cycle. When a specific washing option is selected, the user only needs to touch the desired washing option 542 or its associated check-box 546. Once selected, check-box 546 is filled on display 10, with a check symbol or by otherwise filling in check-box 546. Because only the contents of check-box 546 changes when washing option 542 is selected, the user is given the ability to choose one or more washing options 542 without substantial change in display 10 in a manner similar to screen 320. Screen 540, as well as screen 530, includes a "Start Cycle" option to cause washing appliance 1 to begin the washing cycle. Screen 550 is then shown, and displays information such as fabric type, time remaining and door lock status.

From screen 530, the "Wash/Rinse" option activates screen 570. Screen 570 gives the user the ability to choose the temperature of each of the wash step and the rinse step. Simply selecting a combination, either "COLD/COLD", "WARM/COLD", "WARM/WARM" or "HOT/COLD" returns display 10 to screen 530.

Also from screen 530, the "No Delay" option activates screen 580. Screen 580 gives the user the ability to choose each of the options and cycles to be used, but delay the start of washing appliance 1. Options for "No Delay", "2 Hour Delay", "4 Hour Delay" and "8 Hour Delay" are shown, but a wide range of delay times may be provided. Simply selecting a delay time returns display 10 to screen 530.

The operation of the "Hints & Tips" and "Help" options are identical as the operation in the first embodiment, such that these features will not be discussed further here. Based on the above, it should be apparent that the menu driven control system of the invention provides an enhanced system for programming, as well as increasing the versatility, of a washing machine. However, although described with reference to preferred embodiments, it should be readily understood that various changes and/or modifications could be made to the invention without departing from the spirit thereof. For instance, although the figures depict specific progressions of screens, it is within the scope of this invention to shuffle and reorganize the screens, with one or more of the screens and options being replaced or even eliminated. In addition, the invention can also be applied to other laundry appliances such as a dryer. In any event, the invention is only intended to be limited by the scope of the following claims.

We claim:

1. In a laundry appliance having a central processing unit (CPU) for operating the laundry appliance in accordance with a selected one of a plurality of laundry programs, with each laundry program including at least one operating instruction, a method of controlling the laundry appliance:

providing a touch-screen control panel;

receiving an initial programming input for the appliance from a user through a first screen presented on the control panel, said initial programming input relating to a selected one of the plurality of laundry programs;

prompting the user for additional programming input through a second, distinct screen presented on the control panel; and performing a laundry operation in the laundry appliance, utilizing the operating instruction and each of the initial and additional programming inputs.

2. The method according to claim 1, further comprising:

selecting a different laundry program stored in a memory; and performing the laundry operation based on operating instructions from the different laundry program.

3. The method according to claim 1, further comprising: selectively storing the laundry operation as a favorite laundry program which can be later selected to perform a duplicate set of operation instructions for the laundry appliance.

4. The method according to claim 3, further comprising: storing the favorite laundry program under an alpha format selected and programmed by the user.

5. The method according to claim 1, further comprising: prompting a user for a supplemental control input for further laundry instructions for the laundry operation.

6. The method according to claim 1, further comprising: providing an information database in a memory of the laundry appliance.

7. The method according to claim 6, wherein the information database includes data assisting the user with the laundry programs.

8. The method according to claim 6, wherein the information database contains diagnostic information.

9. A method of controlling a laundry appliance, comprising:

presenting a user with a sequence of programming screens for inputting operating selections through a series of display screens, with successive screens displaying user selections which are dependent on a prior operating selection made by the user; and introducing at least one control display screen between a sequential set of the programming screens, said control display screen pausing the sequences of programming screens to display operational information to the user concerning an automatic laundry operation.

10. The method according to claim 9, wherein the successive screens enable an operating selection of a laundry operation programmed by the user.

11. In a laundry appliance, a menu driven control system comprising:

a display device for presenting a series of successive programming options to a user, with selected programming options of the user being adapted to be made through sequential screens on the display device; and a controller for establishing a laundry operation based on the selected programming options.

12. The menu driven control system according to claim 11, further comprising: memory means for storing a plurality of laundry programs, said display device presenting the laundry programs for selection to the user in an alpha format.

13. In a laundry appliance having a CPU, a memory having stored therein a laundry sequence and at least one laundry operation, and a dynamic display device adapted to depict a plurality of distinct screens, a method of controlling the laundry appliance comprising:

simultaneously presenting a plurality of laundry options to a user through a single menu display; and selecting a plurality of the laundry options without changing the plurality of laundry options displayed on the single menu display.

14. The method of claim 13, wherein the step of simultaneously presenting a plurality of laundry options to a user includes displaying a check-box in proximity to each of the plurality of laundry options in the display device.

15. The method of claim 14, further comprising: placing a symbol in the check-box in proximity to each of the selected laundry options selected by the user.

* * * * *